US011383812B1

(12) United States Patent
Tscherne et al.

(10) Patent No.: US 11,383,812 B1
(45) Date of Patent: Jul. 12, 2022

(54) WATERCRAFT PROPULSION SYSTEM AND METHOD FOR INVERTING A ROTATION OF AN IMPELLER DRIVEN BY A MOTOR OF A WATERCRAFT

(71) Applicant: BRP-ROTAX GMBH & CO. KG, Gunskirchen (AT)

(72) Inventors: Rudolf Tscherne, Buchkirchen (AT); Roman Schmied, Linz (AT); Patrick Waldl, Vorchdorf (AT)

(73) Assignee: BRP-ROTAX GMBH & CO. KG, Gunskirchen (AT)

( * ) Notice: Subject to any disclaimer, the term of this patent is extended or adjusted under 35 U.S.C. 154(b) by 345 days.

(21) Appl. No.: 16/777,156

(22) Filed: Jan. 30, 2020

Related U.S. Application Data

(60) Provisional application No. 62/799,533, filed on Jan. 31, 2019.

(51) Int. Cl.
*B63H 11/107* (2006.01)
*B63H 11/01* (2006.01)
*B63H 23/08* (2006.01)

(52) U.S. Cl.
CPC ..... *B63H 23/08* (2013.01); *B63H 11/01* (2013.01); *B63H 11/107* (2013.01)

(58) Field of Classification Search
CPC ..... B63H 23/08; B63H 11/107; B63H 11/01
See application file for complete search history.

(56) References Cited

U.S. PATENT DOCUMENTS 2,797,659 A * 7/1957 Haase ..... B63H 11/107 60/222
3,807,343 A * 4/1974 Peebles ..... B60K 28/04 440/1
5,839,927 A * 11/1998 Thomas ..... B63H 5/165 440/46
6,033,272 A 3/2000 Whiteside
6,899,575 B1 * 5/2005 Rothe ..... B63H 11/08 440/39
7,841,915 B2 11/2010 Bourret et al.
8,133,087 B1 * 3/2012 Abou Zeid ..... B63H 20/28 440/88 L
9,517,826 B1 * 12/2016 Leblond ..... B63H 11/113
10,919,608 B1 * 2/2021 Kunanec ..... B63H 11/08
2002/0182947 A1 * 12/2002 Ishigaki ..... B63H 11/08 440/43
2003/0104733 A1 * 6/2003 Ishigaki ..... B63H 20/20 440/71
2005/0142011 A1 * 6/2005 Tormaschy ..... C02F 3/16 417/423.15

(Continued)

*Primary Examiner* — William Kelleher
*Assistant Examiner* — Gregory T Prather
(74) *Attorney, Agent, or Firm* — BCF LLP

(57) ABSTRACT

A method for inverting a rotation of an impeller driven by a motor of a watercraft is disclosed. In response to sensing that the motor is stopped, a direct linkage is disconnected between the motor and the impeller and a reverse connection is established between the motor and the impeller. The motor is started after sensing that the reverse connection is established. A watercraft propulsion system having an electronic control unit configured to perform the method and a watercraft including the watercraft propulsion system are also disclosed. Reverse operation of the impeller is useful in removing debris from the jet propulsion system.

21 Claims, 13 Drawing Sheets

(56) References Cited

U.S. PATENT DOCUMENTS

| | | | | |
|---|---|---|---|---|
| 2005/0155922 | A1* | 7/2005 | Tormaschy | E02B 1/003 210/241 |
| 2008/0081521 | A1* | 4/2008 | Mizokawa | B63H 21/213 440/1 |
| 2008/0113570 | A1* | 5/2008 | Kaji | B63H 21/20 440/1 |
| 2012/0021659 | A1* | 1/2012 | Ota | B63H 11/113 440/41 |
| 2015/0110642 | A1* | 4/2015 | Dahouk | F04D 29/5806 417/16 |

* cited by examiner

WATERCRAFT PROPULSION SYSTEM AND METHOD FOR INVERTING A ROTATION OF AN IMPELLER DRIVEN BY A MOTOR OF A WATERCRAFT

CROSS-REFERENCE

The present application claims priority from U.S. provisional patent application Ser. No. 62/799,533, filed on Jan. 31, 2019, the disclosure of which is incorporated by reference herein.

FIELD OF TECHNOLOGY

The present technology relates to a method for inverting a rotation of an impeller driven by a motor and to a watercraft propulsion system.

BACKGROUND

Water jet propelled watercraft offer high performance, good acceleration and handling, and allow for shallow-water operation. Accordingly, personal watercrafts, which typically employ water jet propulsion systems, have become popular, especially in resort areas.

A common problem with jet propulsion systems is that foreign objects such as vegetation (e.g. weeds), rocks, rope and other debris can get drawn into the jet propulsion system and remain lodged therein. For example, foreign objects can get caught on an intake grate, a driveshaft or an impeller of the jet propulsion system. Clogs caused by these foreign objects can in turn adversely affect performance of the system, notably by reducing a thrust generated by the jet propulsion system. In turn, the reduced thrust in combination with high speed rotation of the impeller can form low pressure areas around the blades of the impeller and thus cause cavitation thereof. In addition, the clogs can in some cases block cooling water flow and thus lead to overheating. While the jet propulsion system can be unclogged manually by accessing a bottom of the watercraft's hull, this can be a difficult and time-consuming task for the operator.

To address this issue, it has been proposed to operate a jet propulsion system in reverse such as to propel water towards an inlet thereof (as opposed to a rearward outlet at a steering nozzle of the jet propulsion system) by unlinking an impeller shaft from a motor of the jet propulsion system, and linking again the impeller shaft to the motor to cause the impeller shaft to rotate in a reverse direction. Hence, the generated thrust may be used to clear clogs in the jet propulsion system. However, careless switching between forward and reverse operations of the jet propulsion system could damage mechanical components such as, for example, a gearbox connecting the motor to the impeller shaft.

Moreover, a flow of water that is normally present when the jet propulsion system is operating in the forward direction is useful in cooling an exhaust system of the watercraft. However, such flow is absent, or at least less effective in cooling the exhaust system, when the jet propulsion system is operating in the reverse direction.

In view of the foregoing, there is a need for a watercraft with a jet propulsion system that can be unclogged without causing damage to components of the jet propulsion system.

SUMMARY

It is an object of the present technology to ameliorate at least some of the inconveniences present in the prior art.

According to one aspect of the present technology, there is provided a method for inverting a rotation of an impeller driven by a motor of a watercraft, the method comprising: sensing that the motor is stopped; and in response to sensing that the motor is stopped: disconnecting a direct linkage between the motor and the impeller, establishing a reverse connection between the motor and the impeller, sensing that the reverse connection is established between the motor and the impeller, and starting the motor in response to sensing that the reverse connection is established between the motor and the impeller.

In some embodiments of the present technology, the method further comprises providing a visual or audible fault indication if the reverse connection is not established.

In some embodiments of the present technology, the method further comprises, before disconnecting the direct linkage between the motor and the impeller: receiving a user command requesting reverse operation of the impeller; and providing a visual or audible indication when reverse operation of the impeller is not allowed because the motor is not stopped.

In some embodiments of the present technology, the motor is an internal combustion engine; the method further comprises sensing an exhaust gas temperature; and establishing the reverse connection between the motor and the impeller is conditional to the sensed exhaust gas temperature being less than a temperature threshold.

In some embodiments of the present technology, the method further comprises providing a visual or audible indication when the direct linkage between the motor and the impeller is not disconnected due to the exhaust gas temperature meeting or exceeding the temperature threshold.

In some embodiments of the present technology, the method further comprises stopping the internal combustion engine if the exhaust gas temperature increases to meet or exceed the temperature threshold when operating the internal combustion engine with the reverse connection established between the internal combustion engine and the impeller.

In some embodiments of the present technology, the method further comprises providing a visual or audible indication when the internal combustion engine is stopped due to the exhaust gas temperature meeting or exceeding the temperature threshold.

In some embodiments of the present technology, the method further comprises sensing a speed of the watercraft, establishing the reverse connection between the motor and the impeller being conditional to the speed of the watercraft being less than a maximum speed threshold.

In some embodiments of the present technology, the method further comprises providing a visual or audible indication when the direct linkage between the motor and the impeller is not disconnected due to the speed of the watercraft meeting or exceeding the maximum speed threshold.

In some embodiments of the present technology, the method further comprises starting a timer when starting the motor in response to sensing that the reverse connection is established; and stopping the motor if the timer reaches a duration threshold when operating the motor with the reverse connection established between the motor and the impeller.

In some embodiments of the present technology, the method further comprises providing a visual or audible indication when the motor is stopped due to the timer reaching the duration threshold.

In some embodiments of the present technology, sensing that the motor is stopped comprises sensing a rotational speed of the motor.

In some embodiments of the present technology, the method further comprises limiting the rotational speed of the motor to be less than a rotational speed threshold when operating the motor with the reverse connection established between the motor and the impeller.

In some embodiments of the present technology, the method further comprises providing a visual or audible indication indicating that the rotational speed of the motor is limited by the rotational speed threshold.

In some embodiments of the present technology, the method further comprises energizing an actuator to cause a gearbox to disconnect the direct linkage between the motor and the impeller and to establish the reverse connection between the motor and the impeller.

In some embodiments of the present technology, the method further comprises causing a shaft of the motor to rotate in a range between 5 and 10 degrees to complete the establishment of the reverse connection between the motor and the impeller.

In some embodiments of the present technology, the motor is an internal combustion engine having a crankshaft; and causing the shaft of the motor to rotate comprises providing an impulse command to a starter motor operatively connected to the crankshaft.

According to another aspect of the present technology, there is provided a watercraft propulsion system, comprising: a motor; a motor status sensor adapted for indicating whether the motor is running or stopped; an impeller operatively connected to the motor; an impeller housing receiving the impeller therein; a gearbox comprising a direct linkage and a reversing gear set; an actuator operatively connected to the gearbox and adapted for causing the gearbox to selectively establish an operative connection of the impeller to the motor via one of the direct linkage and the reversing gear set; a gearbox position sensor adapted for indicating whether the impeller is connected to the motor via the direct linkage or the via reversing gear set; an electronic control unit (ECU), comprising: a processor communicating with the motor status sensor, with the actuator and with the gearbox position sensor; and a non-transitory computer-readable medium having stored thereon machine executable instructions for performing, when executed by the processor, the method for inverting a rotation of the impeller.

In some embodiments of the present technology, the motor status sensor is a motor rotational speed sensor.

In some embodiments of the present technology, the motor is an internal combustion engine; the watercraft propulsion system further comprises an exhaust gas temperature sensor communicating with the processor; and the processor is configured to prevent establishing the reverse connection between the internal combustion engine and the impeller if an exhaust gas temperature meets or exceeds a temperature threshold.

In some embodiments of the present technology, the processor is configured to stop the internal combustion engine if the exhaust gas temperature increases to meet or exceed the temperature threshold when the reverse connection is established between the engine and the impeller.

In some embodiments of the present technology, the watercraft propulsion system further comprises: a timer communicating with the processor; the processor being configured to evaluate a time duration of operation of the motor with the reverse connection established between the motor and the impeller and to stop the motor if the time duration reaches a duration threshold.

In some embodiments of the present technology, the gearbox comprises: an input shaft having one end driven by the motor and an opposite end having a first set of dogs; and an output shaft having one end operatively connected to the impeller and an opposite end having a second set of dogs; the direct linkage being established when the first set of dogs comes in contact with the second set of dogs.

In some embodiments of the present technology, the reversing gear set comprises: a shifting rod operatively connected to the actuator, the actuator causing the shifting rod to move to a reversing position in response to receiving a reversing command and to move to a normal position in response to receiving a forwarding command; a shifting fork connecting the shifting rod to the output shaft so that the second set of dogs of the output shaft engages the first set of dogs of the input shaft when the shifting rod is in the normal position, the shifting fork causing a displacement of the output shaft away from the input shaft to disengage the first and second sets of dogs when the shifting rod is in the reversing position; and a shifting shaft adapted for being displaced in parallel to the shifting rod, the shifting shaft carrying gears that engage gears mounted on the input and output shafts to cause a rotation of the output shaft in a direction opposite from a rotation of the input shaft when the shifting rod is in the reversing position, the gear carried by the shifting shaft being disengaged from the gears mounted on the input and output shafts when the shifting rod is in the normal position.

In some embodiments of the present technology, the gearbox position sensor is adapted for detecting a position of the shifting rod.

In some embodiments of the present technology, the watercraft propulsion system further comprises an impeller shaft operatively connecting the gearbox to the impeller.

In some embodiments of the present technology, the actuator is an electric actuator.

In some embodiments of the present technology, the actuator is a stepper motor.

According to a further aspect of the present technology, there is provided a watercraft comprising: a hull having a bow and a stern opposite the bow; a duct having a water inlet on a lower side of the hull and a water outlet; and the watercraft propulsion system; the impeller housing forming a portion of the duct, the impeller being adapted to force water to flow into the duct from the water inlet and to be expelled from the water outlet to propel the watercraft when the watercraft propulsion system operates in the forward direction, the impeller being adapted to force water to flow into the duct from the water outlet and to be expelled from the water inlet when the watercraft propulsion system operates in the reverse direction.

In some embodiments of the present technology, the watercraft further comprises: a vehicle speed sensor for sensing a speed of the watercraft, the vehicle speed sensor communicating with the processor; the processor being configured to prevent establishing the reverse connection between the motor and the impeller if the speed of the watercraft meets or exceeds a maximum speed threshold.

In some embodiments of the present technology, the watercraft further comprises a display cluster communicating with the ECU and adapted for providing visual or audible indications of statuses of the jet propulsion system.

In some embodiments of the present technology, the processor is further configured to stop the motor when the reverse connection between the motor and the impeller is established and the speed of the watercraft meets or exceeds the maximum speed threshold.

Embodiments of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of embodiments of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
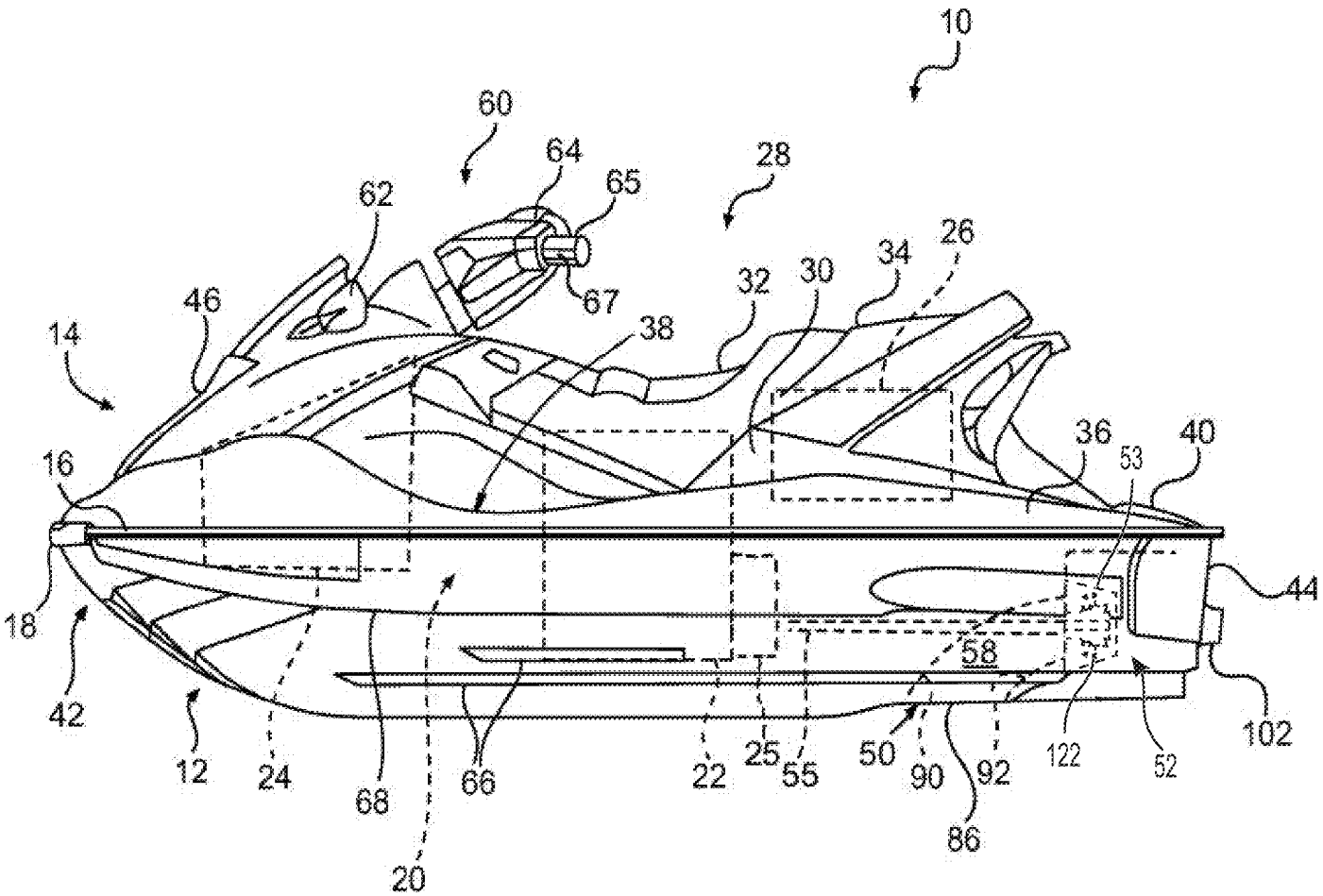
FIG. 1 is a left side elevation view of a personal watercraft in accordance with an embodiment of the present technology.

The present technology will be described with respect to a personal watercraft. However, it is contemplated that the present technology could be applied to other marine vehicles equipped with a jet propulsion system or to marine vehicles equipped with other types of watercraft propulsion systems. Application of the present technology is therefore not intended to be limited to its use in personal watercraft or to jet propulsion systems. Additionally, while an intended use of the present technology is to operate the impeller of the personal watercraft in a reverse direction to help unclogging the jet propulsion system, the present technology can also be used for other applications that benefit from reverse operation of the impeller.

A personal watercraft 10 in accordance with one embodiment of the present technology is shown in FIGS. 1 to 5. The following description relates to one example of a personal watercraft. Those of ordinary skill in the art will recognize that there are other known types of personal watercraft incorporating different designs and that the present technology would encompass these other watercrafts.

As will be discussed in greater detail below, the personal watercraft 10 has a jet propulsion system 50 for propelling the watercraft 10. In accordance with the present technology, the jet propulsion system 50, including a venturi unit 100 thereof, is configured to reverse a flow of water therein in such a manner as to clear the jet propulsion system 50 of foreign bodies.

The watercraft 10 has a hull 12 and a deck 14. The hull 12 has a bow 42 and a stern 44 opposite the bow 42. The hull 12 buoyantly supports the watercraft 10 in the water. The deck 14 is designed to accommodate one or multiple riders. The hull 12 and the deck 14 are joined together at a seam 16 that joins the parts in a sealing relationship. A bumper 18 generally covers the seam 16, which helps to prevent damage to the outer surface of the watercraft 10 when the watercraft 10 is docked, for example.

As seen in FIG. 1, the deck 14 has a centrally positioned straddle-type seat 28 positioned on top of a pedestal 30 to accommodate multiple riders in a straddling position. The seat 28 includes a front seat portion 32 and a rear, raised seat portion 34. The seat 28 is preferably made as a cushioned or padded unit, or as interfitting units. The front and rear seat portions 32, 34 are removably attached to the pedestal 30. The seat portions 32, 34 can be individually tilted or removed completely. Seat portion 32 covers a motor access opening defined by a top portion of the pedestal 30 to provide access to a motor 22. Seat portion 34 covers a removable storage bin 26. A small storage box is provided in front of the seat 28.

Figure 2:
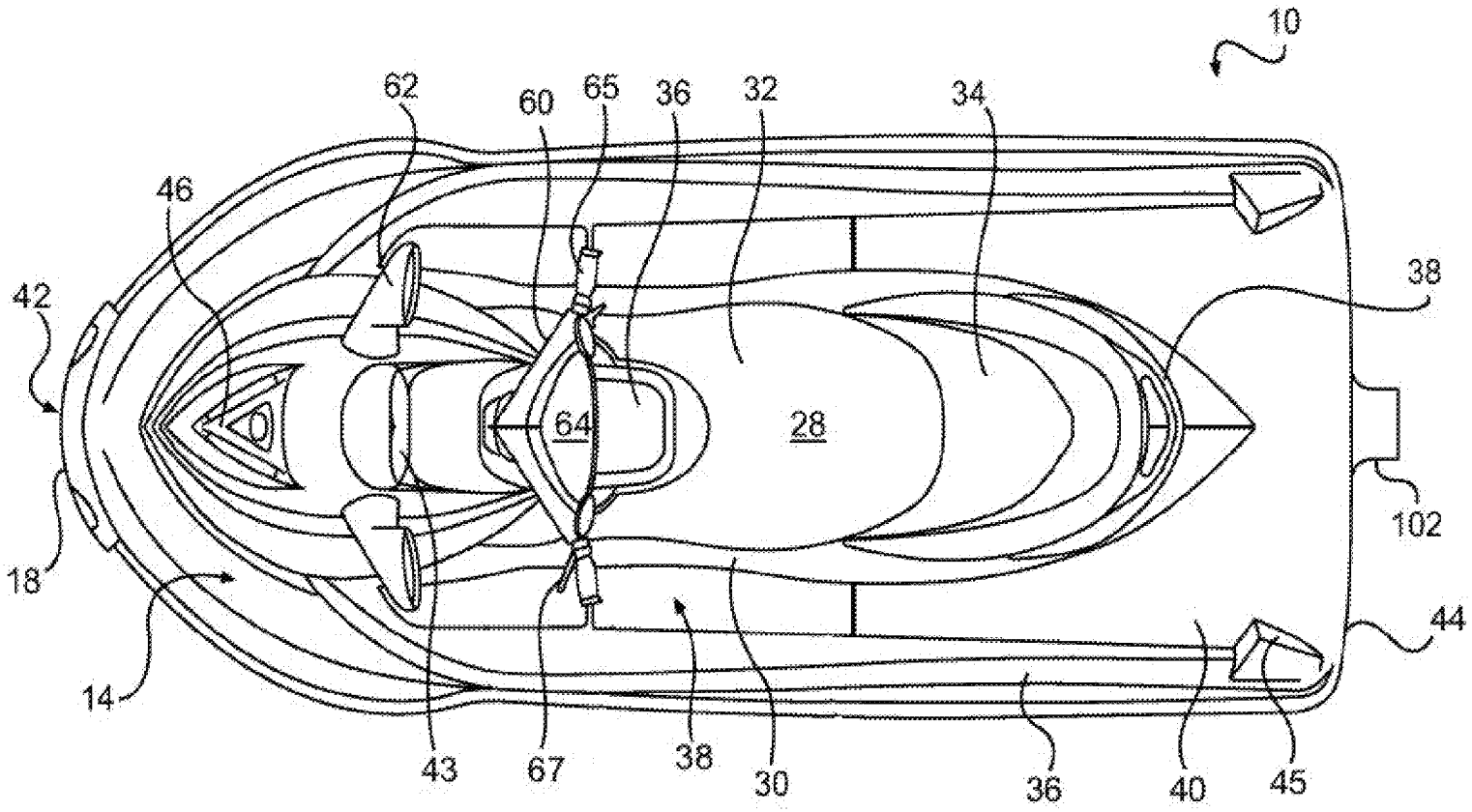
FIG. 2 is a top plan view of the watercraft of FIG. 1.

The watercraft 10 has a pair of generally upwardly extending walls located on either side of the watercraft 10 known as gunwales or gunnels 36. The gunnels 36 help to prevent the entry of water in the footrests 38 of the watercraft 10, provide lateral support for the riders' feet, and also provide buoyancy when turning the watercraft 10, since the personal watercraft 10 may roll slightly when turning. Towards the rear of the watercraft 10, the gunnels 36 extend inwardly to act as heel rests 45 (FIG. 2). A passenger riding the watercraft 10 facing towards the rear, to spot a waterskier for example, may place his or her heels on the heel rests 45, thereby providing a more stable riding position. Heel rests 45 could also be formed separately from the gunnels 36.

Located on both sides of the watercraft 10, between the pedestal 30 and the gunnels 36, are the footrests 38. The footrests 38 are designed to accommodate the riders' feet in various riding positions. The footrests 38 are covered by carpeting made of a rubber-type material, for example, to provide additional comfort and traction for the feet of the riders.

A reboarding platform 40 is provided at the rear of the watercraft 10 on the deck 14 to allow the rider or a passenger to easily reboard the watercraft 10 from the water. Carpeting or some other suitable covering may cover the reboarding platform 40. A retractable ladder (not shown) may be affixed to a transom 47 of the stern 44 to facilitate boarding the watercraft 10 from the water onto the reboarding platform 40.

Figure 3:
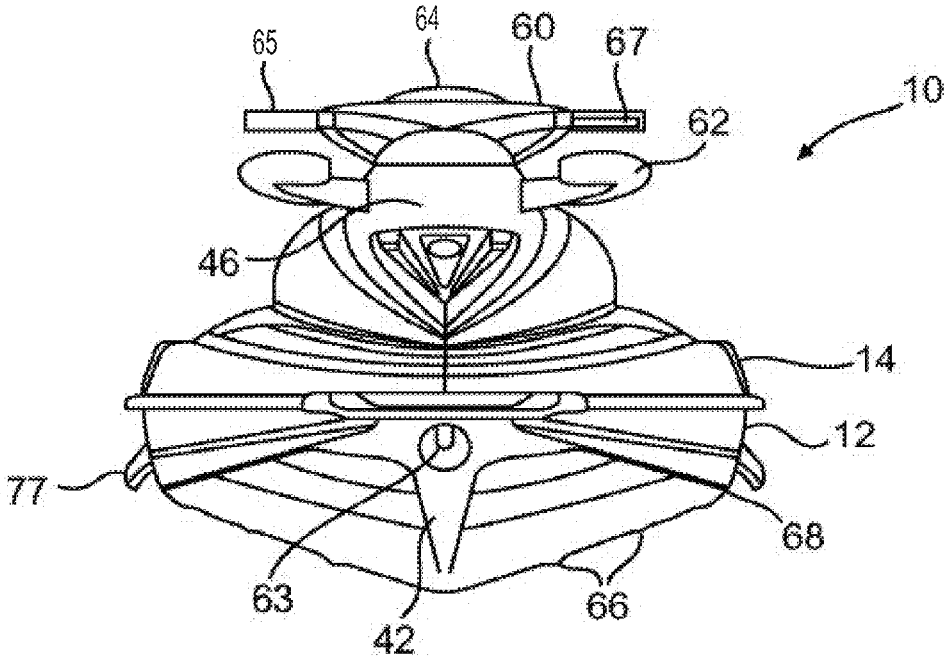
FIG. 3 is a front elevation view of the watercraft of FIG. 1.

Referring to the bow 42 of the watercraft 10, as seen in FIG. 1, the watercraft 10 is provided with a hood 46 located forwardly of the seat 28 and a helm assembly 60. A hinge (not shown) is attached between a forward portion of the hood 46 and the deck 14 to allow the hood 46 to move to an open position to provide access to a front storage bin 24. A latch (not shown) located at a rearward portion of the hood 46 locks the hood 46 into a closed position. When in the closed position, the hood 46 prevents water from entering the front storage bin 24. Rearview mirrors 62 are positioned on either side of the hood 46 to allow the rider to see behind the watercraft 10. A hook 63 is located at the bow 42 of the watercraft 10 (FIG. 3). The hook 63 is used to attach the watercraft 10 to a dock when the watercraft 10 is not in use or to attach to a winch when loading the watercraft 10 on a trailer, for instance.

As best seen in FIG. 1, the hull 12 is provided with a combination of strakes 66 and chines 68. A strake 66 is a protruding portion of the hull 12. A chine 68 is the vertex formed where two surfaces of the hull 12 meet. The combination of strakes 66 and chines 68 provide the watercraft 10 with its riding and handling characteristics.

Sponsons 77 (FIGS. 2 and 3) are located on both sides of the hull 12 near the transom 47. The sponsons 77 have an arcuate undersurface that gives the watercraft 10 both lift while in motion and improved turning characteristics. The sponsons 77 are fixed to the surface of the hull 12 and can be attached to the hull 12 by fasteners or molded therewith. It is contemplated that the position of the sponsons 77 with respect to the hull 12 may be adjustable to change the handling characteristics of the watercraft 10 and accommodate different riding conditions.

The hull 12 has a tunnel 94 in which a part of the jet propulsion system 50 is received. The tunnel 94 is defined at the front, sides and top by the hull 12 and is open at the transom 47. The bottom of the tunnel 94 is closed by a ride plate 96. The ride plate 96 creates a surface on which the watercraft 10 rides or planes at high speeds.

Figure 4:
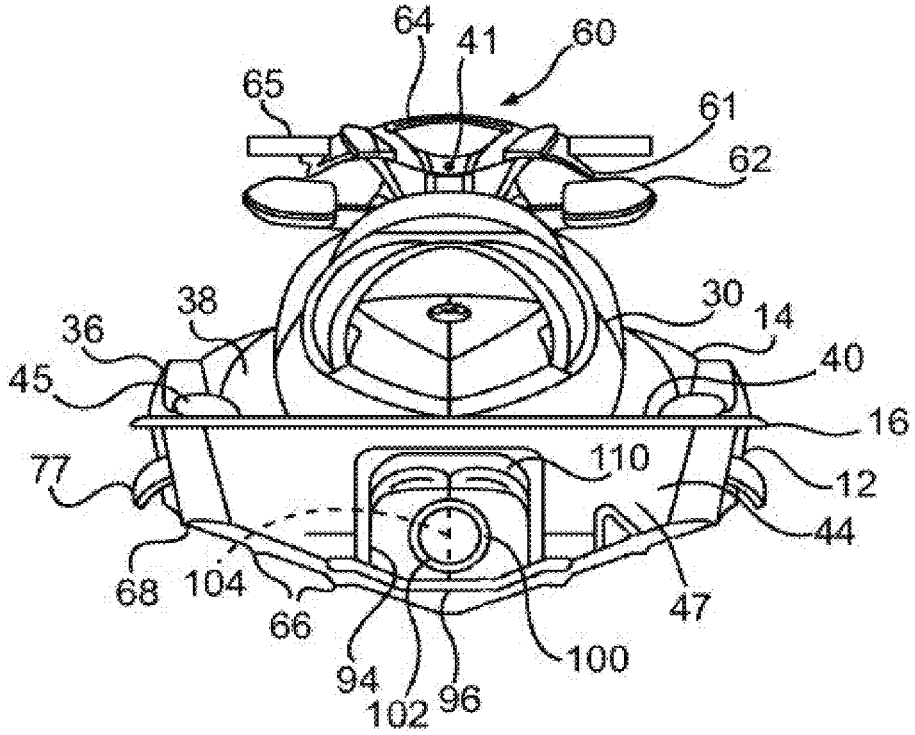
FIG. 4 is a rear elevation view of the watercraft of FIG. 1.

As best seen in FIGS. 3 and 4, the helm assembly 60 is positioned forwardly of the seat 28. The helm assembly 60 has a central helm portion 64, that is padded, and a handlebar 65 having steering handles at its opposite ends. One of the steering handles is provided with a throttle operator 61 (FIG. 4), which allows the rider to control the motor 22, and therefore the speed of the watercraft 10. The throttle operator 61 is a thumb-actuated throttle lever. However it is contemplated that the throttle operator 61 could be a finger-actuated throttle lever or a twist grip. The throttle operator 61 is movable between an idle position and multiple actuated positions. In the present embodiment, the throttle operator 61 is biased towards the idle position, such that, should the driver of the watercraft 10 let go of the throttle operator 61, it will move to the idle position. The other of the steering handles is provided with a reverse gate operator 67 (FIG. 4) used by the driver to actuate a reverse gate 110 (FIG. 4) of the watercraft 10. The reverse gate operator 67 is a finger-actuated lever. However, it is contemplated that the reverse gate operator 67 could be a thumb-actuated lever or a twist grip.

The reverse gate 110 is movable between a stowed position (FIG. 4) where it does not interfere with the jet of water being expelled rearwardly along a duct 52 by the jet propulsion system 50 and a plurality of positions where it redirects the jet of water being expelled rearwardly along the duct 52 by the jet propulsion system 50. Notably, the reverse gate 110 may be actuated into a neutral position in which thrust generated by the jet propulsion system 50 does not have a horizontal component such that the watercraft 10 will not be accelerated or decelerated by the thrust and will generally stay in position if it was not moving prior to moving the reverse gate 110 in the neutral position. The reverse gate 110 may also be actuated into a reverse position to redirect the jet of water towards the front of the watercraft 10, thus causing the watercraft 10 to move in a reverse direction.

The reverse gate 110 is pivotally connected to the ride plate 96. It is also contemplated that the reverse gate 110 could be pivotally attached to the sidewalls of the tunnel 94. Other ways of operatively mounting the reverse gate 110 to the hull 12 or jet propulsion system 50 are also contemplated.

A reverse gate actuator (not shown), in the form of an electric motor, is operatively connected to the reverse gate 110 to move the reverse gate 110. The reverse gate actuator could alternatively be any one of a mechanical, a hydraulic, or another type of electric actuator. One contemplated reverse gate actuator is shown and described in U.S. Pat. No. 7,841,915, issued Nov. 30, 2010, the entirety of which is incorporated herein by reference.

The helm assembly 60 is provided with a key receiving post 41 located near a center of the central helm portion 64. The key receiving post 41 is adapted to receive a key (not shown) that starts the watercraft 10. The key is typically attached to a safety lanyard (not shown) that may be attached to a safety vest of a rider of the watercraft 10. It should be noted that the key receiving post 41 may be placed in any suitable location on the watercraft 10.

A display area or cluster 43 is located forwardly of the helm assembly 60. The display cluster 43 can be of any conventional display type, including a liquid crystal display (LCD), dials or LED (light emitting diodes). The central helm portion 64 has various buttons, which could alternatively be in the form of levers or switches, that allow the driver to modify the display data or mode (speed, motor RPM, time, fuel level, and the like) on the display cluster 43 or to change a condition of the watercraft 10, such as trim (the pitch of the watercraft 10).

As shown schematically in FIG. 1, the motor 22 is supported by the hull 12 and is enclosed within a motor compartment 20 defined between the hull 12 and the deck 14. The motor 22 is configured for driving the jet propulsion system 50 (also commonly referred to as a "jet pump drive") which propels the watercraft 10. The motor compartment 20 accommodates the motor 22, as well as a muffler, tuning pipe, gas tank, electrical system (battery, electronic control unit, and the like), air box, storage bins 24, 26, and other elements required or desirable in the watercraft 10. In this embodiment, the motor 22 is an internal combustion engine 22 and will thus be referred to as the engine 22. However, it is contemplated that, in alternative embodiments, the motor 22 may be any other suitable type of motor such as an electric motor. As will be understood, in such an embodiment, certain components would be added to or omitted from the watercraft 10 (e.g., no muffler and gas tank, and the like).

The jet propulsion system 50 pressurizes water to create thrust. To that end, the jet propulsion system 50 has a duct 52 (FIG. 1) in which water is pressurized and which is defined by various components of the jet propulsion system 50. Notably, the duct 52 is defined in part by a water inlet defined on a lower side of the hull 12, an intake ramp 58, an impeller 122, an impeller housing 53 receiving the impeller 122 therein, a venturi unit 100 and a steering nozzle 102 of the jet propulsion system 50.

The steering nozzle 102 defines a water outlet of the duct 52 of the jet propulsion system 50. Notably, the steering nozzle 102 is disposed rearwardly of the venturi unit 100 such that, when the jet propulsion system 50 propels water rearwardly, water flows from the venturi unit 100 into the steering nozzle 102.

The steering nozzle 102 is pivotally attached to the venturi unit 100 so as to pivot about a vertical axis 104 (FIG. 4). The steering nozzle 102 could also be supported at the exit of the tunnel 94 in other ways without a direct connection to the venturi unit 100. When the jet propulsion system 50 propels water rearwardly along the duct 52, the steering nozzle 102 selectively directs the thrust generated by the jet propulsion system 50 to effect turning. The steering nozzle 102 can be replaced by a rudder or other diverting mechanism disposed at the exit of the tunnel 94 to selectively direct the thrust generated by the jet propulsion system 50.

The engine 22 has a crankshaft 126 (FIG. 7) that extends longitudinally. A gearbox 25 is connected to the crankshaft via an input shaft 136 (FIG. 8) and is disposed in the motor compartment 20 rearwardly of the engine 22. An impeller shaft 55 is connected to an output shaft 138 (FIG. 8) of the gearbox 25 and is connected to the jet propulsion system 50 as will be described further below. The gearbox 25 is operable to selectively change a direction of rotation of the impeller shaft 55. Notably, the gearbox 25 can selectively rotate the impeller shaft 55 clockwise or counter clockwise by engaging different gearing in the gearbox 25 to drive the impeller shaft 55. The gearbox 25 will be described in greater detail below.

The jet propulsion system 50 can be operated to propel water forwardly or rearwardly along the duct 52. Notably, when motion of the watercraft 10 is desired, the jet propulsion system 50 is selectively made to propel water rearwardly along the duct 52. However, as will be explained further below, the jet propulsion system 50 can also be selectively made to propel water forwardly along the duct 52 in order to clear foreign bodies clogging the duct 52.

Figure 5:
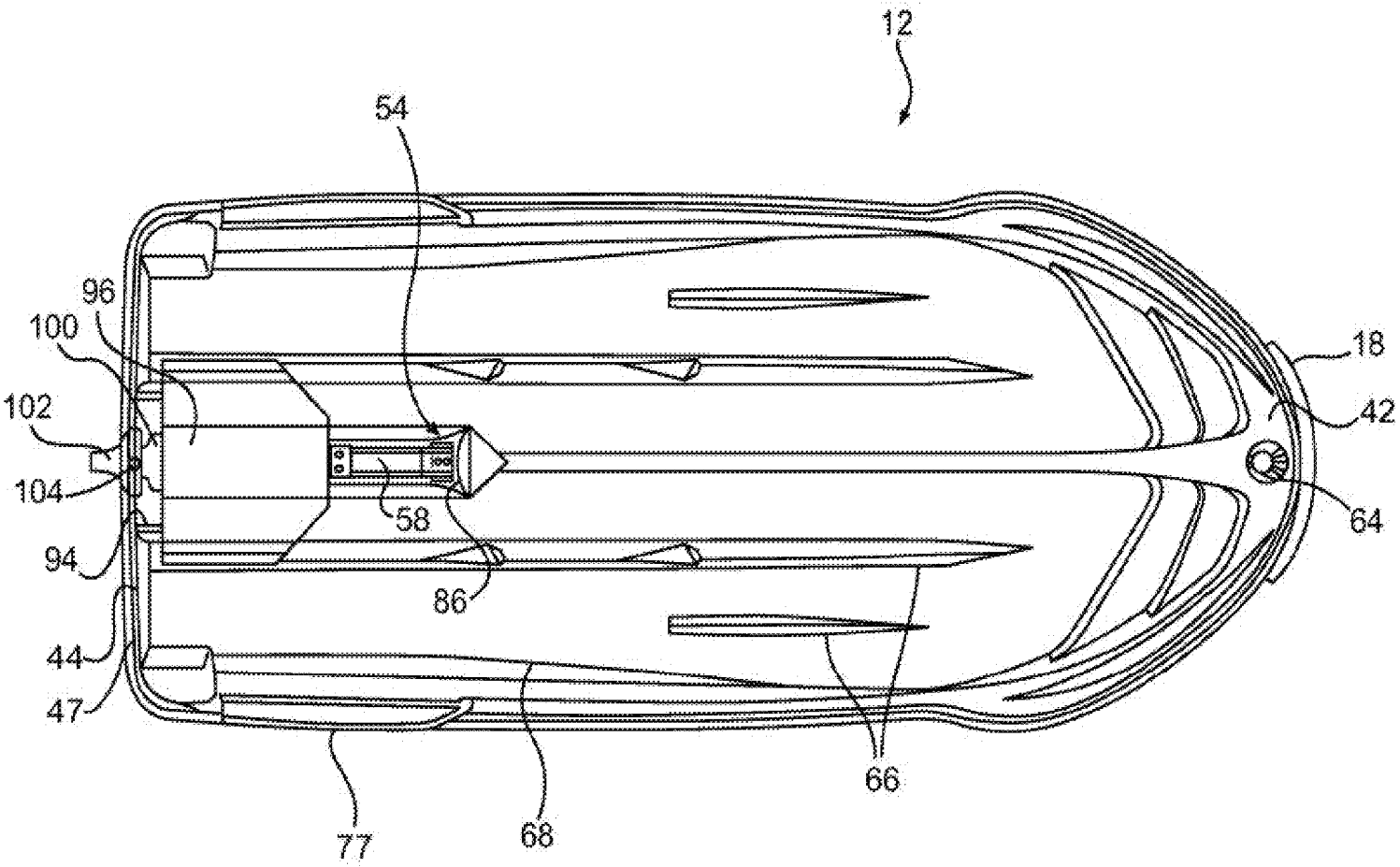
FIG. 5 is a bottom plan view of the watercraft of FIG. 1.

As best seen in FIG. 5, the duct 52 has an inlet 86 positioned under the hull 12. When the jet propulsion system 50 propels water rearwardly, water is first scooped into the inlet 86. An inlet grate 54 is positioned adjacent (i.e., at or near to) the inlet 86 and is configured to prevent large rocks, weeds, and other debris from entering the water jet propulsion system 50, which may damage the system or negatively affect performance. It is contemplated that the inlet grate 54 could be positioned in the inlet 86. Water flows from the inlet 86 through the water intake ramp 58. As shown on FIG. 1, the intake ramp 58 has a top portion 90 that is formed by the hull 12 and a bottom portion 92.

The impeller housing 53 is positioned rearwardly of the intake ramp 58 such that, when the jet propulsion system 50 propels water rearwardly along the duct 52, water flows into the impeller housing 53 from the intake ramp 58. The impeller housing 53 is located in the tunnel 94 of the hull 12. The impeller housing 53 is fastened to the tunnel 94 of the hull 12 via bolts that engage openings (not shown) in the impeller housing 53 and corresponding openings in the front wall of the tunnel 94.

Figure 6:
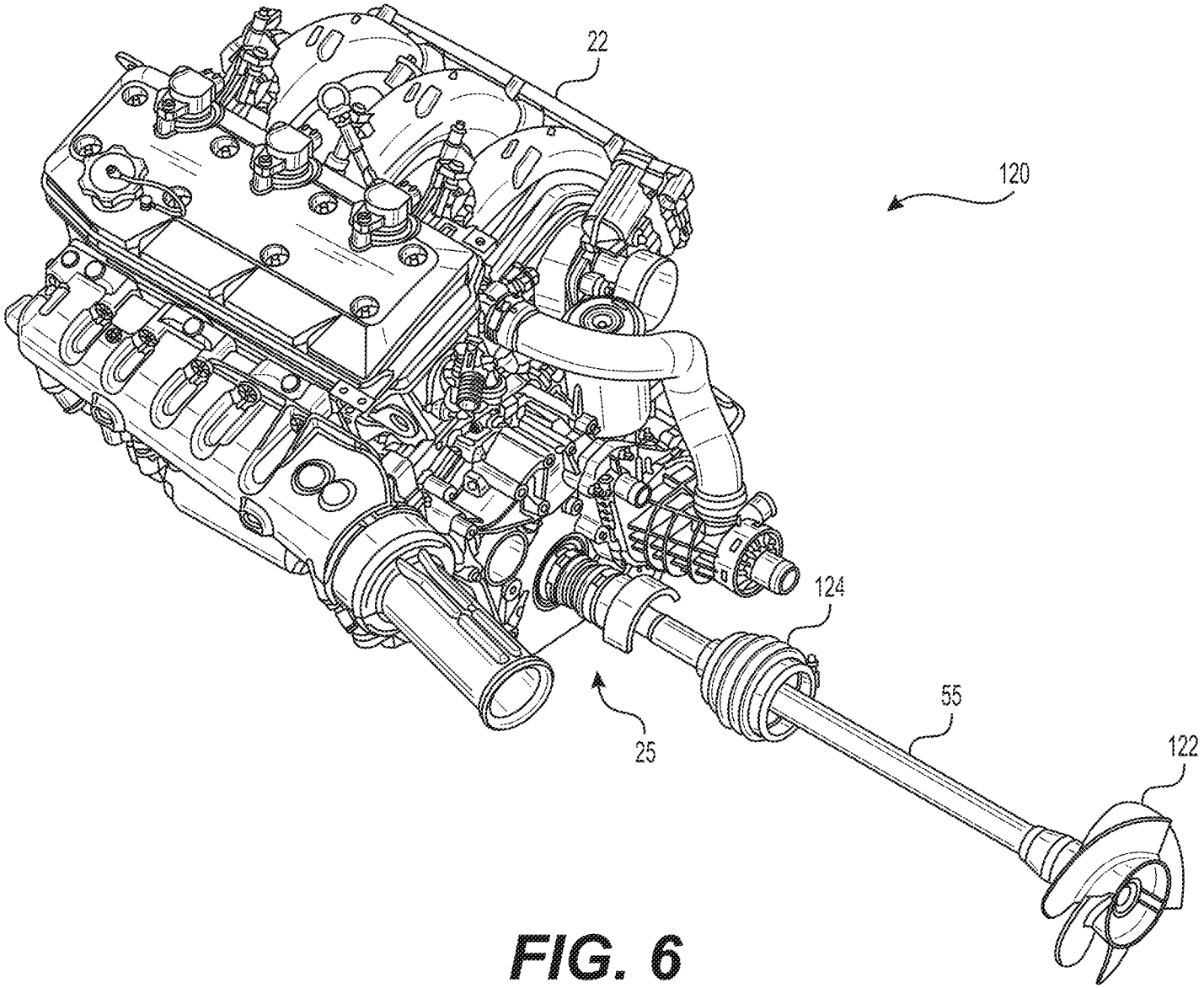
FIG. 6 is a perspective view of a driveline of the watercraft of FIG. 1 showing a motor, an impeller shaft and an impeller.

Referring now to FIG. 6, a driveline 120 for the watercraft 10 includes the engine 22, the gearbox 25, the impeller shaft 55 and the impeller 122. A bellow assembly 124 is mounted to the impeller shaft 55 and provides a seal between the duct 52 and the interior of the hull 12 so as to prevent entry of water into the hull 12. The jet propulsion system 50 is configured to cause the impeller 122 to rotate in a forward direction in normal operation, and in a reverse direction for unclogging the jet propulsion system 50. In reverse operation, water is propelled forwardly along the duct 52, water being sucked into the duct 52 via the outlet of the steering nozzle 102. In most occurrences, this action facilitates the dislodgement of debris or other foreign bodies clogging the duct 52.

Figure 7:
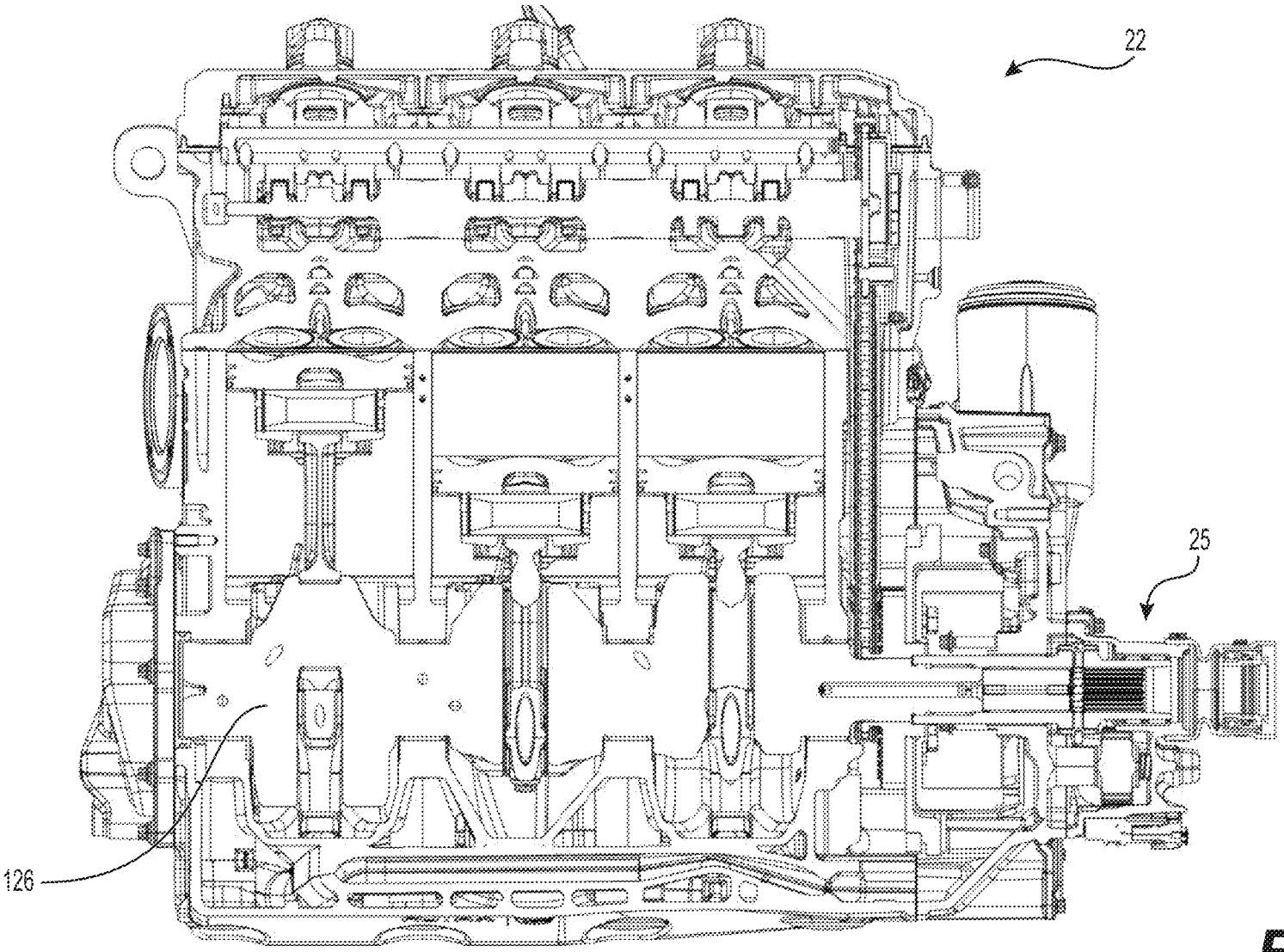
FIG. 7 is a cross-section view of the motor of FIG. 6 and of a gearbox connecting the motor to the impeller shaft.
Figure 8:
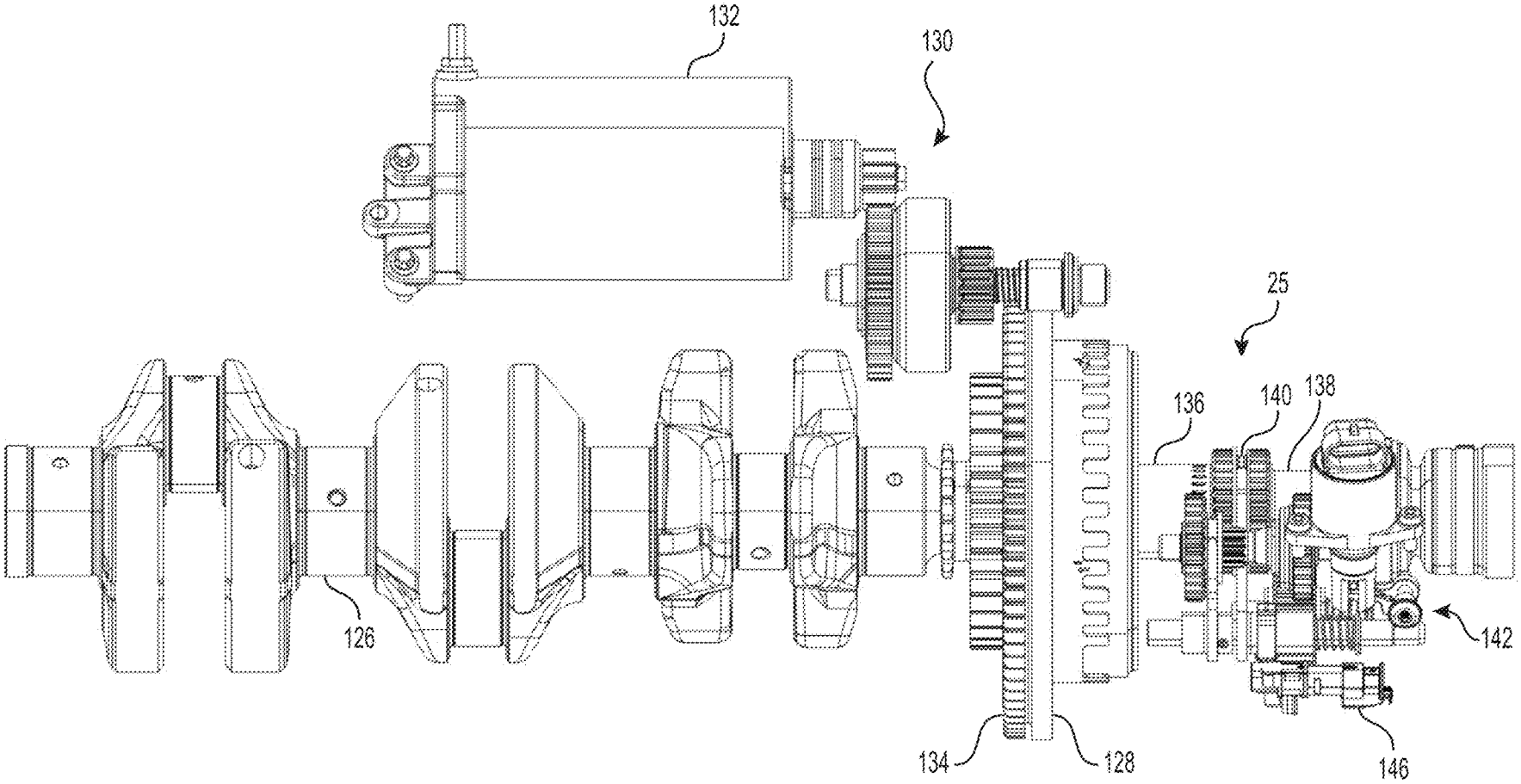
FIG. 8 is a side elevation view of components of the driveline of FIG. 6.

FIGS. 7 and 8 provide further details of the driveline 120. The engine 22 has a crankshaft 126 connected to a flywheel 128. A starter gear set 130 allows to selectively connect a starter motor 132 to a toothed gear 134 mounted on the flywheel 128 when the starter motor 132 is energized. The gearbox 25 includes an input shaft 136 operatively connected to the crankshaft 126. The input shaft 136 extends on a side of the flywheel 128 opposite from the crankshaft 126. In an embodiment, the input shaft 136 is hollow and one end of the crankshaft 126 extending through the flywheel 128 is press-fitted in a matching end of the input shaft 136. In turn, another end of the input shaft 136 opposite from the crankshaft 126 is operatively connected to an output shaft 138 of the gearbox 25 as will be described below. The gearbox 25 also comprises a direct linkage 140 to selectively connect the input shaft 136 to the output shaft 138 in the forward direction as well as a reversing gear set 142 to selectively connect the input shaft 136 to the output shaft 138 in the reverse direction. The impeller shaft 55 is connected to the output shaft 138 via splines (not shown) located within another bellow assembly 144. These splines allow some relative longitudinal movement of the output shaft 138 in relation to the impeller shaft 55 while maintaining an engagement of the impeller shaft 55 to the output shaft 138. A slight angular motion is also allowed between longitudinal axes of the output shaft 138 and of the impeller shaft 55.

Figure 9:
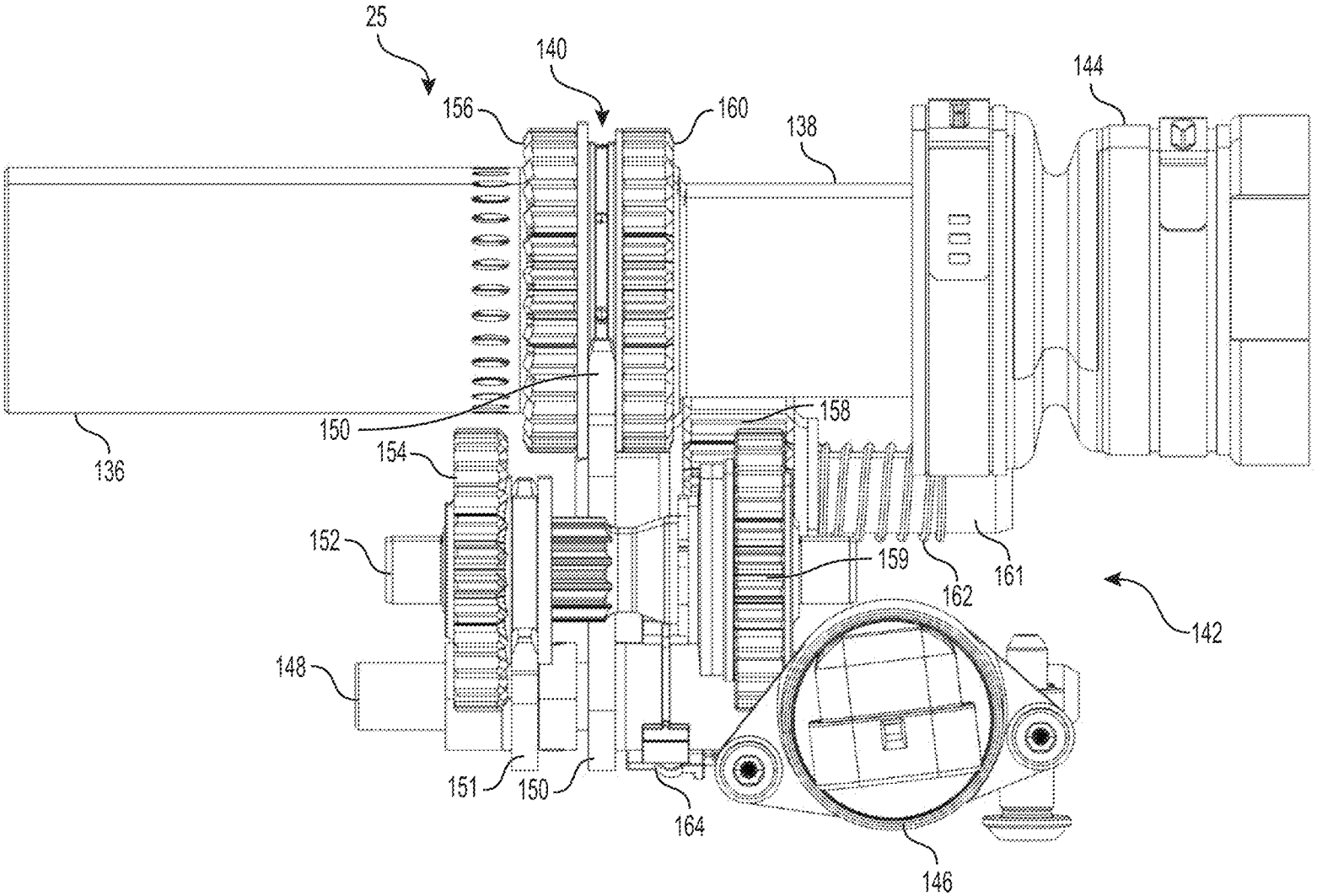
FIG. 9 is a top view of the gearbox of FIG. 7 showing an input shaft connected to an output shaft in a forward direction.
Figure 10:
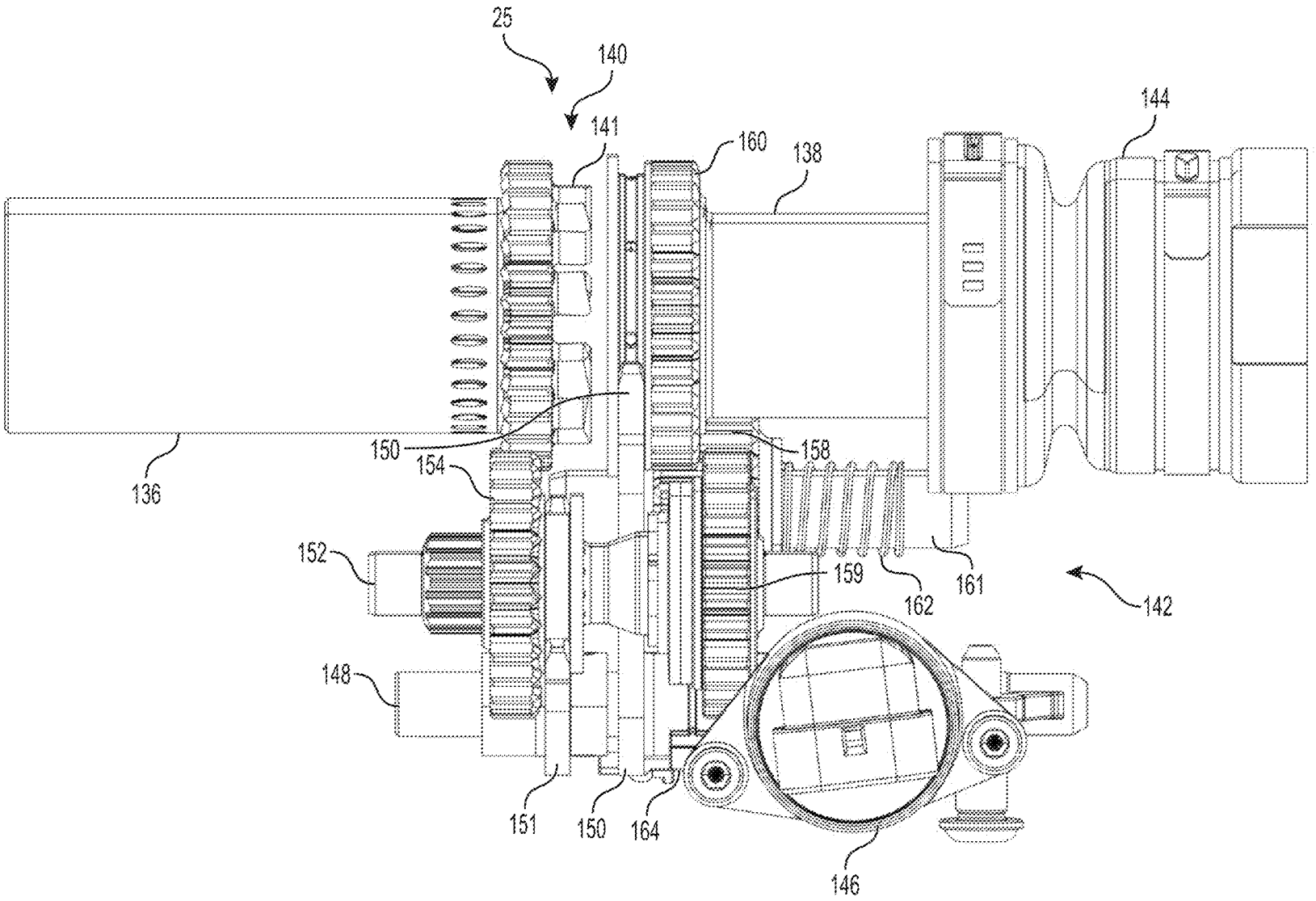
FIG. 10 is a top view of the gearbox of FIG. 9 showing the input shaft connected to the output shaft in a reverse direction.

FIGS. 9 and 10 provide more details of the gear set 25. When the gear set 25 operates in the forward direction (FIG. 9), the input shaft 136 is directly connected to the output shaft 138 via the direct linkage 140 that, in the present embodiment, includes a set of dogs 141 on a mating end of the input shaft 136 that engage another set of dogs (not shown) on a mating end of the output shaft 138. To operate the gearbox 25 in the reverse direction (FIG. 10), the output shaft 138 is moved away from the input shaft 136 to disengage the direct linkage 140.

Figure 11:
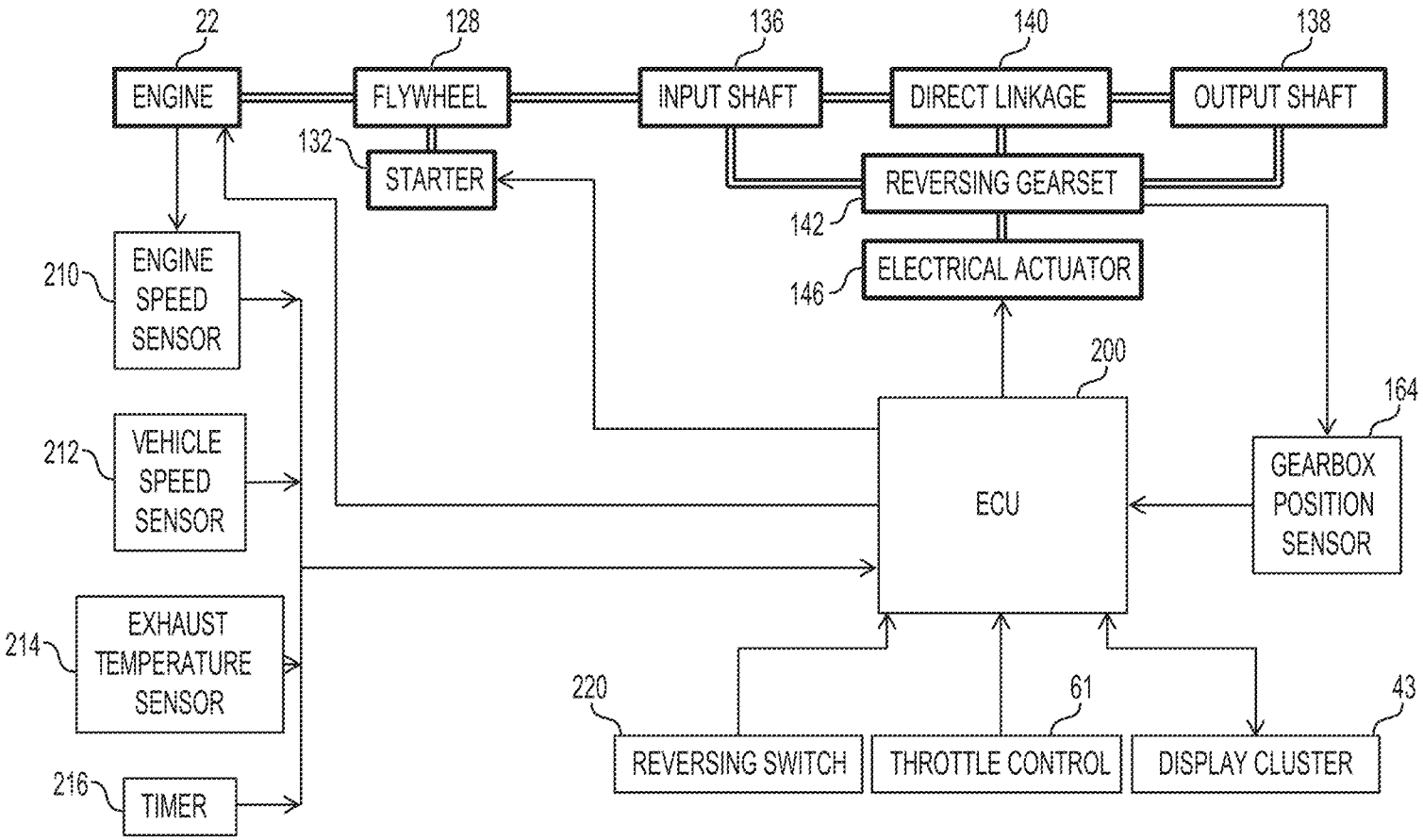
FIG. 11 is a block diagram of a system for inverting a rotation of the impeller of FIG. 6.

An electrical actuator 146 operatively connected to the gear set 25 is controlled by commands received from an electronic control unit (ECU) 200 (FIG. 11). In an embodiment, the electrical actuator 146 is a stepper motor adapted to configure the gear set 25 in opposite directions depending on the nature of the command from the ECU 200. To change the operation of the jet propulsion system 50 from the forward direction to the reverse direction, the ECU 200 sends a reversing command to the electrical actuator 146. In response to the reversing command, the electrical actuator 146 causes a longitudinal displacement of a shifting rod 148 from a normal position (FIG. 9) to a reversing position (FIG. 10). The shifting rod 148 is displaced in parallel to a longitudinal axis of the input shaft 136 and moves away from the engine 22 as the gearbox 25 is shifted to the reverse direction. A first shifting fork 150 connects the shifting rod 148 to the output shaft 138. A second shifting fork 151 connects the shifting rod 148 to a shifting shaft 152 of the reversing gear set 142. The longitudinal displacement of the shifting rod 148 displaces the first shifting fork 150, in turn causing a parallel longitudinal displacement of the output shaft 138, away from the input shaft 136, disengaging the respective sets of dogs that form the direct linkage 140. In the illustrated embodiment, the longitudinal displacement of the output shaft 136 is of about 10 mm, which is sufficient to disengage the direct linkage 140. At the same time, the longitudinal displacement of the shifting rod 148 displaces the second shifting fork 151, in turn causing a parallel longitudinal displacement of the shifting shaft 152, causing a gear 154 mounted to the shifting shaft 152 to engage a gear 156 of the input shaft 136 while gear a 159 mounted to the shifting shaft 152 engages a gear 160 of the output shaft 138 via a gear 158 rotatably supported by an intermediate rod 161 and meshing with the gear 159. In an embodiment, the ECU 200 may shortly thereafter send a brief impulse command to the starter motor 132 to cause a slight rotation of the crankshaft 126, the flywheel 128 and the input shaft 136. This facilitates alignment of the gears 156, 160 of the input and output shafts 136, 138 with the gears 154, 158 of the reversing gear set 142. In embodiments using an electric motor instead of the engine 22, an impulse command may also be applied to cause a slight rotation of a rotor with the same result.

As a result of the engagement of the various gears 154, 156, 158, 159 and 160, the reversing gear set 142 is in condition for transmitting power from the input shaft 136, which is rotating in the forward direction, to the output shaft 138, causing the output shaft 138 and the impeller shaft 55 to rotate in the reverse direction. A spring 162 positioned on the intermediate rod 161 applies a pressure on the gear 158 to further facilitate its alignment with the gear 160.

The ECU 200 sends a forwarding command to the electrical actuator 146 to cause the shifting rod 148 to return to its normal position as shown on FIG. 9 so that the watercraft 10 may be propelled in the forward direction again. At the same time, the shifting fork 150 brings the output shaft 138 toward the input shaft 136 to be connected therewith by the respective sets of dogs of the direct linkage 140. Also at the same time, the shifting shaft 152 moves in parallel with the shifting rod 148, causing the gears 154, 156, 158, 159 and 160 to become disengaged.

A gearbox position sensor 164 detects any displacement of the shifting rod 148. The gearbox position sensor 148 may comprise a Hall sensor or another linear sensor. Use of a switch indicating that the shifting rod 148 is positioned to engage the gearbox 25 in the forward or in the reverse position is also contemplated. It is also contemplated that the gearbox position sensor 164 could directly sense the position of the output shaft 138 or the position or another component of the gear set 142, inasmuch as this component adopts different positions when the gearbox 25 is in the forward and reverse directions. Details of the gearbox 25, in particular details of the direct linkage 140 and of the reversing gear set 142, may vary as using various other types of reversible gearboxes to connect the crankshaft 126 to the impeller shaft 55 are contemplated.

In an embodiment, the driveline 120 is configured such that the impeller shaft 55 and the impeller 122 rotate whenever the motor 22 is running. In such case, any attempt to disengage the direct linkage 140 of the gearbox 25 while the motor 22 is running could cause damage to the respective sets of dogs on the input shaft 136 and on the output shaft 128. In the particular example of the gearbox 25 that uses the sets of dogs to establish the direct link 140, attempting to engage or disengage the direct link 140 while the engine 22 is running or attempting to restart the engine 22 while the sets of dogs 141 of the direct link 140 are not fully engaged might cause noise and might damage the gearbox 25.

Turning now to FIG. 11, several components of a watercraft propulsion system of the watercraft 10 are reproduced in block form. On FIG. 11, double lines between the various shown elements illustrate mechanical connections between these elements. Single lines illustrate electrical connections, signaling and message exchange between other elements.

An electronic control unit (ECU) 200 generally controls the engine 22 and various other functions of the watercraft 10. The ECU 200 comprises a processor, or a plurality of cooperating processors, as well as one or more memory devices operatively connected to the processor or processors. The one or more memory devices include a non-transitory computer-readable medium that stores machine executable instructions that are executable by the processor or cooperating processors.

The ECU 200 is in communication with various sensors and electronic components of the watercraft 10. The ECU 200 receives signals from the gearbox position sensor 164, a motor speed sensor 210, a vehicle speed sensor 212, and a timer 216. In an embodiment, the timer 216 may be integrated within the ECU 200. The motor speed sensor 210 detects a rotational speed of the motor in view of determining whether the motor is currently running, or not. Use of another type of motor status sensor that provides a binary indication that the motor is currently running, or not, is also contemplated. In the particular case where the motor is the engine 22 as illustrated, an exhaust gas temperature sensor 214 may sense a temperature of gases being exhausted by the engine 22 and the motor speed sensor 210 may sense the rotational speed of the crankshaft 126 or a rotational speed of any other component that rotates in synchrony with the crankshaft 126. Depending on the actual component sensed by the motor speed sensor 210, the motor speed sensor 210 or the ECU 200 is adapted to account for a speed ratio between that component and the engine crankshaft 126. When the motor is an electric motor, the motor speed sensor 210 may for example sense a rotational speed of a rotor of the electric motor.

The ECU 200 also receives commands from the throttle operator 61 to control a power of the engine 22 and from a reversing switch 220 that the user may actuate to request reverse operation of the impeller 122. In an embodiments, commands from the reversing switch 220 may be transmitted to the ECU 200 via the display cluster 43. The reversing switch 220 may comprise a pushbutton, a toggle switch, and the like. The ECU 200 sends information, such as statuses related to operation of the jet propulsion system 50, for visible or audible display on the display cluster 43.

The ECU 200 is configured to send commands to the electric actuator 146 for selecting, in the gearbox 25, whether the input shaft 136 and the output shaft 138 are to be connected via the direct linkage 140 or via the reversing gear set 142 based on an input received from the reversing switch 220. In an embodiment, a reversing command from the ECU 200 energizes the actuator 146 to cause a displacement of the shifting rod 148, resulting in the selection of the reversing gear set 142. A forwarding command from the ECU 200 energizes the actuator 146 to cause a displacement of the shifting rod 148 in an opposite direction, resulting in the selection of the direct linkage 140.

Generally speaking, the processor of the ECU 200 executes machine executable instructions stored in the non-transitory computer-readable medium to control the reverse operation of the impeller 122. To this end, the ECU 200 responds to a command received from the reversing switch 220, either directly or via the display cluster 43, to initiate reverse operation of the impeller 122. The ECU 200 uses information received from the various sensors 210, 212, 214 and 164 as well as from the timer 216 and from the reversing switch 220 to determine whether the reverse operation of the impeller 122 may be initiated or not. In an embodiment, the reverse operation is not started if the engine 22 is not fully stopped, or if a vehicle speed reported by the vehicle speed sensor 212 is above a maximum speed threshold, or if the exhaust gas temperature sensor 214 reports a temperature of gases exhausted by the engine 22 above a temperature threshold. If the reverse operation is allowed, the ECU 200 sends a command to the electrical actuator 146 to cause reversing of the gearbox 25. In most cases, the gearbox 25 is reversed by the electrical actuator 146 without delay. In an embodiment, the ECU may read the signal from the gearbox position sensor 164 after a predetermined time deemed sufficient for the reversing of the gearbox 25. If the gearbox position sensor 164 indicates that the reverse position of the gearbox 25 has not yet been established, the ECU 200 may send an impulse command to the starter motor 132 to cause a slight rotation of the crankshaft 126, the flywheel 128 and the input shaft 136 for alignment of the various components of the gearbox 25. A duration of the impulse command to the starter motor 132 may depend on mechanical parameters of the driveline 120, depending for example on an inertia of the driveline 120. Without limitation, a 20 to 40 millisecond duration for the impulse command may suffice to properly align the various components of the gearbox 25. If, after this impulse command, the signal received from the gearbox position sensor 164 still indicates that the reverse position of the gearbox 25 has not been established, the ECU 200 may repeat the impulse command to the starter motor 132. After a predetermined number of attempts to establish the reverse position of the gearbox 25, for example five times, the ECU may determine to abort the procedure and send a command to the electrical actuator 146 to return the gearbox 25 to the forward position.

In an embodiment, in the course of the reverse operation, the ECU 200 may use an input from the throttle operator 61 to control a speed of the engine 22. In another embodiment, the ECU 200 may use a continuous input from the reversing switch 220 being held by the user to stop the engine 22, place the gearbox 25 in reverse mode, restart the engine 22 and control a stable speed of the engine 22 until the user releases the continuous input on the reversing switch 220. Regardless, the ECU 200 uses information from at least some sensors and from the timer 216 to determine whether reverse operation of the impeller 122 needs to be stopped. The ECU 200 may at all time send messages to the display cluster 43 to request visual or audible display of various statuses of the jet propulsion system 50 related to the reverse operation of the impeller 122.

In particular, where the watercraft 10 is propelled by an internal combustion engine such as the engine 22, the ECU 200 may prevent starting the engine 22 while the reverse connection is established between the engine 22 and the impeller 122 if an exhaust gas temperature meets or exceeds a temperature threshold. As a non-limiting example, the temperature threshold may be set to 80° C. when measured near the end of a water-cooled exhaust pipe (not shown) where a normal operating temperature may be of about 50° C. Also in this case, the ECU 200 may stop the engine 22 if the exhaust gas temperature increases to meet or exceed the temperature threshold when operating the engine 22 while the reverse connection is established between the engine 22 and the impeller 122.

The ECU 200 may use information from the timer 216 to evaluate a time duration of operation of the engine 22 while the reverse connection is established between the engine 22 and the impeller 122, and then stop the engine 22 if the time duration reaches a duration threshold, for example 10 seconds in a non-limiting embodiment.

The vehicle speed sensor 212 may provide a speed of the watercraft 10 to the ECU 200. The ECU 200 may prevent establishing the reverse connection between the engine 22 and the impeller 122, or stop the engine 22, if the speed of the watercraft 10 meets or exceeds a maximum speed threshold, for example 10 km/h in a non-limiting embodiment.

In an embodiment, rather than simply preventing starting of the engine 22, the ECU 200 may refrain from initiating any action leading to the reverse operation of the impeller 122 if the speed of the watercraft 10 meets or exceeds the maximum speed threshold, if the exhaust gas temperature meets or exceeds the temperature threshold, or if the engine 22 is running when receiving the request for reverse operation of the impeller 122 from the reversing switch 220.

Figure 12A:
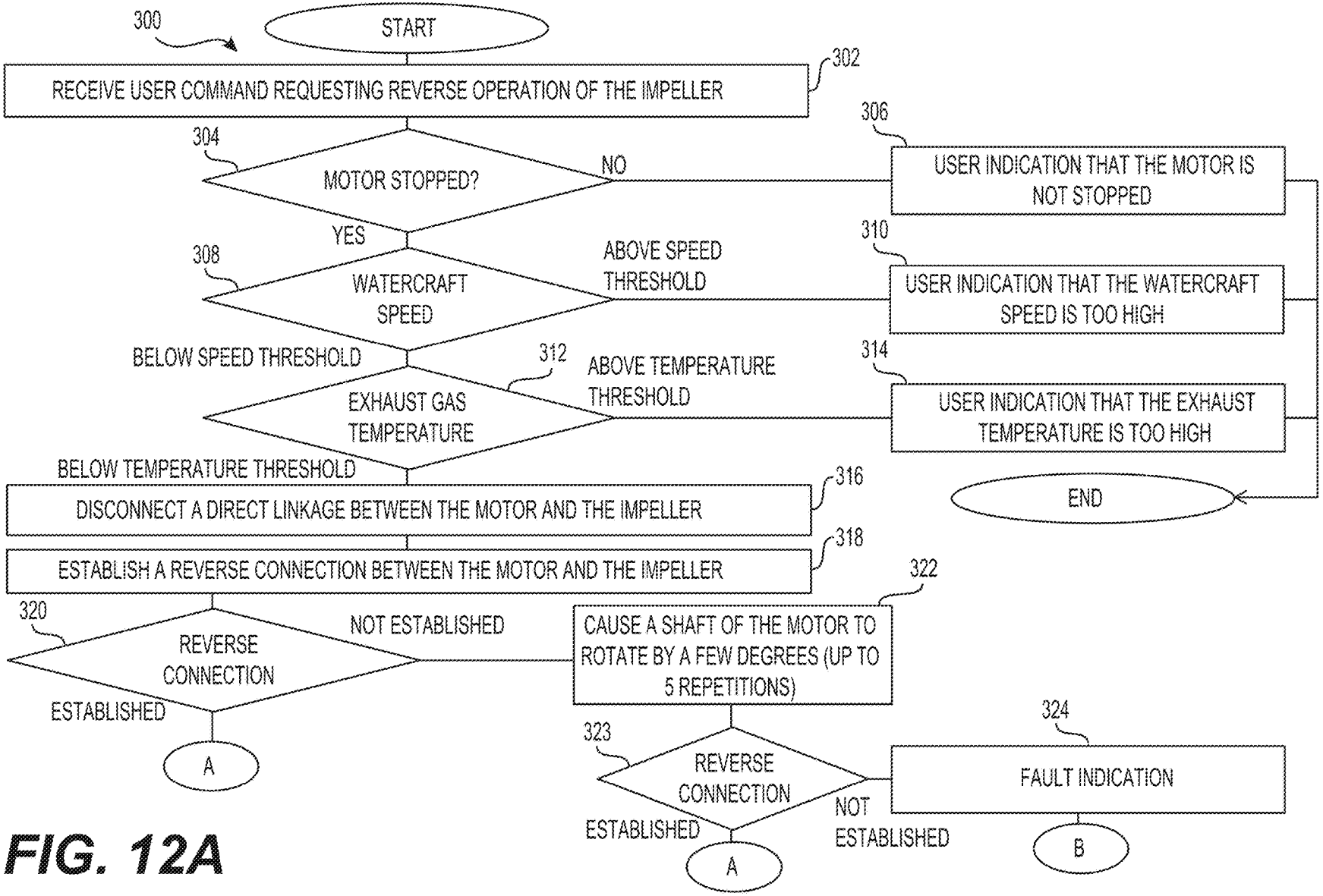
FIGS. 12*a*, 12*b* and 12*c* are a sequence diagram showing operations of a method for inverting the rotation of the impeller of FIG. 6.
Figure 12B:
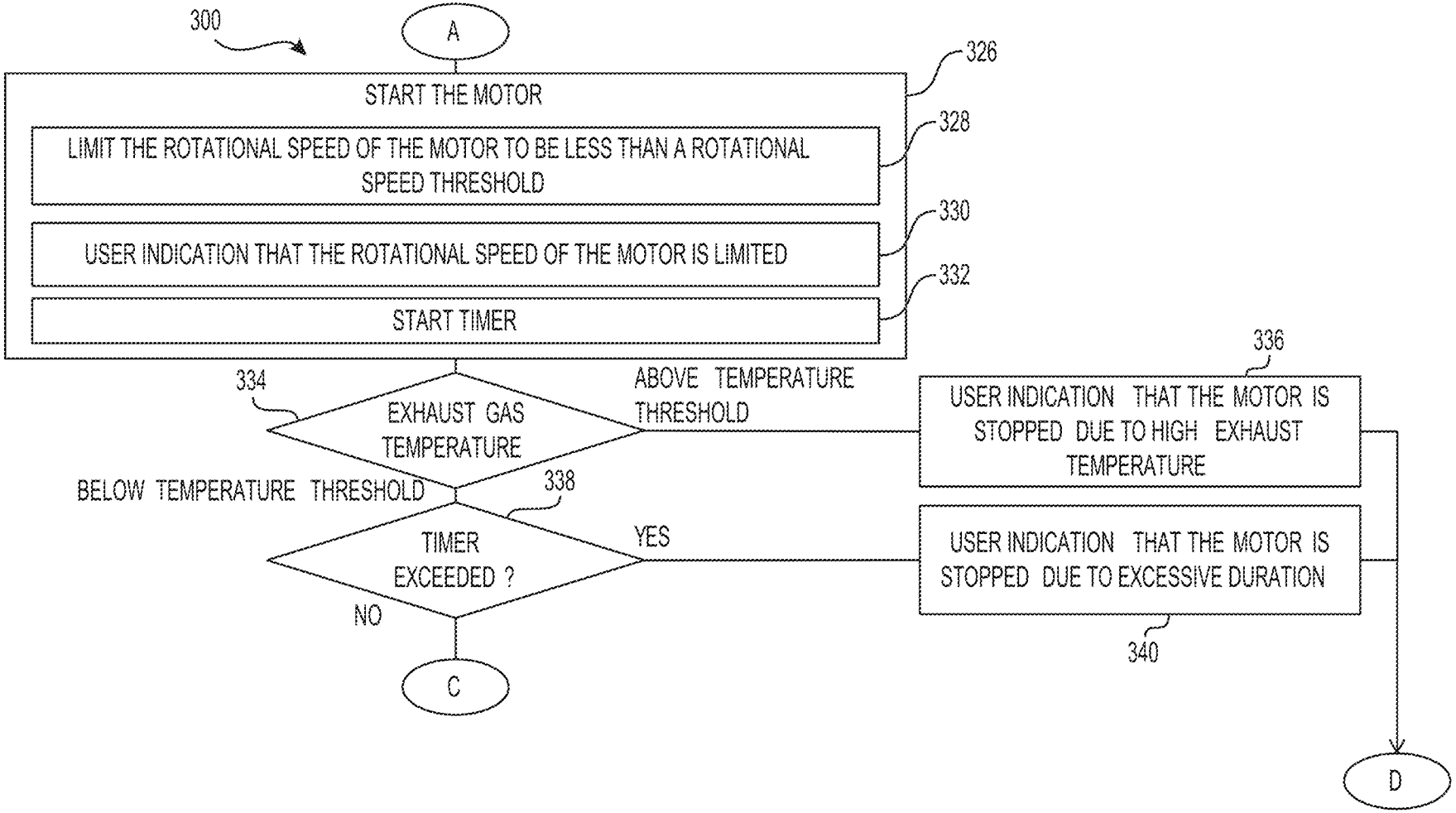
Figure 12C:
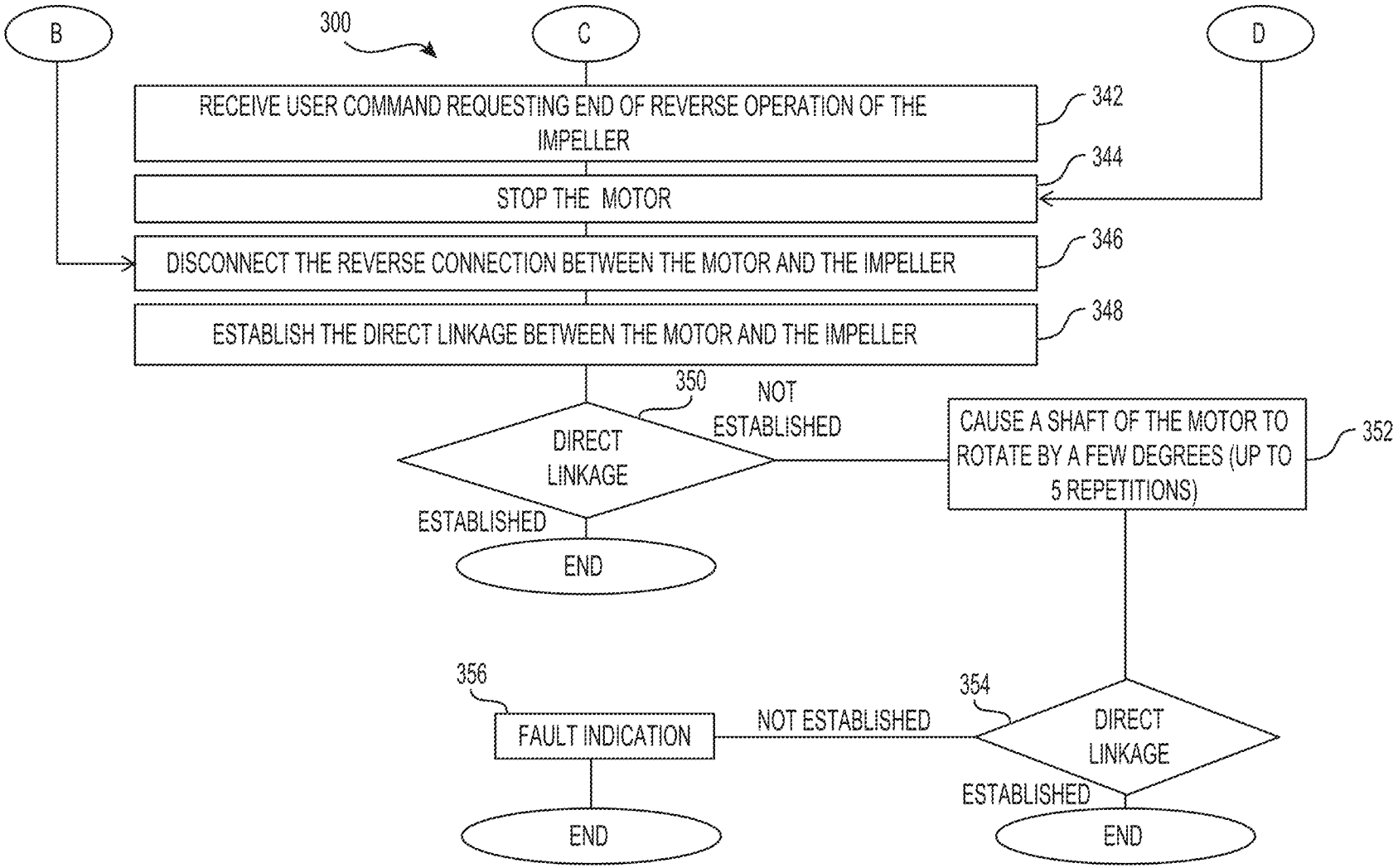

Referring now to FIGS. 12*a*, 12*b* and 12*c*, a sequence 300 comprises a plurality of operations, some of which may be executed in variable order, some of the operations possibly being executed concurrently, some of the operations being optional. At operation 302, a user command requesting reverse operation of the impeller 122 is received at the ECU 200 from the reversing switch 220. A test is made at operation 304 to determine that that the engine 22 is stopped. This test may be based on a reading from the engine speed sensor 210, the ECU 200 determining that the engine 22 is stopped when the rotational speed of the engine 22 is zero (0) RPM. If the engine 22 is not stopped, a visual or audible indication indicating that the sequence cannot be initiated while the engine 22 is not stopped is provided on the display cluster 43 at operation 306 and the sequence 300 ends. It may be noted that, in another embodiment, the ECU 200 may initiate stopping of the engine 22 in response to receiving the user command at operation 302.

If the engine is stopped, another test may be made at operation 308 to evaluate a speed of the watercraft 10. This evaluation may be made at the ECU 200 based on a reading from the vehicle speed sensor 212. If the speed of the watercraft 10 is above a speed threshold, a visual or audible indication indicating that the sequence cannot be initiated due to an excessive speed of the watercraft 10 is provided on the display cluster 43 at operation 310 and the sequence 300 ends.

If the engine is stopped and if the speed of the watercraft 10 is below the speed threshold, a further test may be made at operation 312 to evaluate an exhaust gas temperature. This evaluation may be made at the ECU 200 based on a reading from the exhaust gas temperature sensor 214. If the exhaust gas temperature is above a temperature threshold, a visual or audible indication indicating that the sequence cannot be initiated due to an excessive exhaust gas temperature is provided on the display cluster 43 at operation 314 and the sequence 300 ends.

When none of the tests 304, 308 and 312 prevent reverse operation of the impeller 122, the direct linkage 140 between the engine 22 and the impeller 122, specifically between the input shaft 136 and the output shaft 138 of the gearbox 25, is disconnected at operation 316. Operation 318 comprises the establishment of a reverse connection between the engine 22 and the impeller 122 via the reversing gear set 142 of the gearbox 25.

In the embodiment of the gearbox 25 as illustrated in FIGS. 9 and 10, operations 316 and 318 are performed concurrently by the ECU 200 energizing the actuator 146 to execute operations 316 and 318.

At operation 320, the ECU 200 may use a signal from the gearbox position sensor 164 to verify that the reverse connection between the engine 22 and the impeller 122 is properly established. If the reverse connection is not properly established, the ECU 200 may execute operation 322 to briefly energize the starter motor 132 to cause the crankshaft 126 to rotate by a few degrees to complete the establishment of the reverse connection between the engine 22 and the impeller 122. In a non-limiting example, a 20 to 40 millisecond duration for the impulse command applied by the ECU 200 to the starter motor 132 may cause the crankshaft to rotate by about 5 to 10 degrees. Operation 322 may comprise a predetermined number of repetitions, for example five repetitions, of the brief energization of the starter motor 132 in other attempts to establish the reverse connection between the engine 22 and the impeller 122. If operation 323 determines that the reverse connection still cannot be established after the predetermined number of repetitions, a fault indication is provided on the display cluster 43 at operation 324 and the sequence 300 continues at operation 346 (FIG. 12*b*) where the reverse operation of the impeller is aborted.

Following the establishment of the reverse connection between the engine 22 and the impeller 122, as verified at operation 320 or 323, the engine 22 is started at operation 326 (FIG. 12*b*), causing the impeller 122 to rotate in the reverse direction, which is opposite from its normal operation. Operation 326 may include sub-operations 328, 330 and/or 332. At sub-operation 328, the ECU 200 sets a maximum rotational speed threshold for the engine 22, for example 5000 RPM, so that the engine 22 will not exceed this rotational speed threshold while the reverse connection is established between the engine 22 and the impeller 122, even when a full throttle indication is received from the throttle operator 61. In the same or another embodiment, operation 326 may be aborted if the engine 22 is not successfully started after five (5) seconds. At sub-operation 330, a visual or audible indication is provided on the display cluster 43 to indicate that the rotational speed of the engine is limited by the rotational speed threshold. A timer is started at sub-operation 332.

While the engine 22 is running with the reverse connection established between the engine 22 and the impeller 122, a test is continuously made at operation 334 to verify that the exhaust gas temperature does not rise above the temperature threshold. If the exhaust gas temperature rises above the temperature threshold, a visual or audible indication indicating that the engine 22 is stopped due to an excessive exhaust gas temperature is provided on the display cluster 43 at operation 336 and the engine is stopped at operation 344.

In parallel to operation 334, another test is made at operation 338 to verify whether the timer has reached a duration threshold. If the timer has exceeded the duration threshold, a visual or audible indication indicating that the engine 22 is stopped due to an excessive duration of the reverse operation of the impeller 122 is provided on the display cluster 43 at operation 336 and the engine is stopped at operation 344. It is contemplated that further tests may be added to the tests of operations 334 and 338. For example and without limitation, one test may verify that the vehicle speed reported by the vehicle speed sensor 212 is below the maximum speed threshold, and another test may verify that the gearbox position sensor 164 continuously reports a correct position of the gearbox 20. Use of a sensor of a rotation of the impeller 122 to detect an eventual blockage of the impeller 122 is also contemplated.

A user command requesting an end of the reverse operation of the impeller 122 may be received at the ECU 200 from the reversing switch 220 at operation 342, following which the engine 22 is stopped at operation 344. The engine 22 is stopped at operation 344, either automatically or in response to the user command. After the engine 22 has been stopped, the reverse connection between the engine 22 and the impeller 122 is disconnected at operation 346 and the direct linkage 140 is established between the engine 22 and the impeller 122 at operation 348. Operations 346 and 348 may also follow a determination that the sequence 300 is aborted due to a failure to establish the reverse connection at operation 323.

At operation 350, the ECU 200 may use a signal from the gearbox position sensor 164 to verify that the direct linkage 140 is properly established between the engine 22 and the impeller 122. If so, the sequence 300 ends after operation 350. If the direct linkage 140 is not properly established, the ECU 200 may execute operation 352 to briefly energize the starter motor 132 to cause the crankshaft 126 to rotate by a few degrees to complete the establishment of direct linkage 140 between the engine 22 and the impeller 122. In a non-limiting example, a 20 to 40 millisecond duration for the impulse command applied by the ECU 200 to the starter motor 132 may cause the crankshaft to rotate by up to about 20 degrees, this rotation being larger than in operation 322 in order to facilitate an alignment of the sets of dogs of the input and output shafts 136 and 138. Operation 352 may comprise a predetermined number of repetitions, for example five repetitions, of the brief energization of the starter motor 132 in other attempts to establish the direct linkage 140 between the engine 22 and the impeller 122. Operation 354 may determine that the direct linkage 140 is properly established and the sequence 300 ends. If operation 354 determines that the direct linkage 140 still cannot be established after the predetermined number of repetitions, a fault indication is provided on the display cluster 43 at operation 356 and the sequence 300 ends.

Each of the operations of the sequence 300 may be configured to be processed by one or more processors, the one or more processors being coupled to one or more memory devices, the one or more processors and the one or more memory devices being for example implemented in the ECU 200.

Modifications and improvements to the above-described embodiments of the present technology may become apparent to those skilled in the art. The foregoing description is intended to be exemplary rather than limiting. The scope of the present technology is therefore intended to be limited solely by the scope of the appended claims.

What is claimed is:

1. A method for inverting a rotation of an impeller driven by a motor of a watercraft, the method comprising:

sensing that the motor is stopped; and in response to sensing that the motor is stopped:

disconnecting a direct linkage between the motor and the impeller, establishing a reverse connection between the motor and the impeller, sensing that the reverse connection is established between the motor and the impeller, and starting the motor in response to sensing that the reverse connection is established between the motor and the impeller.

2. The method of claim 1, further comprising, before disconnecting the direct linkage establishing the reverse connection between the motor and the impeller:

receiving a user command requesting reverse operation of the impeller; and providing a visual or audible indication when reverse operation of the impeller is not allowed because the motor is not stopped.

3. The method of claim 1, wherein:

the motor is an internal combustion engine;

the method further comprises sensing an exhaust gas temperature; and establishing the reverse connection between the motor and the impeller is conditional to the sensed exhaust gas temperature being less than a temperature threshold.

4. The method of claim 3, further comprising stopping the internal combustion engine if the exhaust gas temperature increases to meet or exceed the temperature threshold when operating the internal combustion engine with the reverse connection established between the internal combustion engine and the impeller.

5. The method of claim 1, further comprising sensing a speed of the watercraft, wherein establishing the reverse connection between the motor and the impeller is conditional to the speed of the watercraft being less than a maximum speed threshold.

6. The method of claim 1, further comprising:

starting a timer when starting the motor in response to sensing that the reverse connection is established; and stopping the motor if the timer reaches a duration threshold when operating the motor with the reverse connection established between the motor and the impeller.

7. The method of claim 1, wherein sensing that the motor is stopped comprises sensing a rotational speed of the motor, the method further comprising limiting the rotational speed of the motor to be less than a rotational speed threshold when operating the motor with the reverse connection established between the motor and the impeller.

8. The method of claim 1, further comprising energizing an actuator to cause a gearbox to disconnect the direct linkage between the motor and the impeller and to establish the reverse connection between the motor and the impeller.

9. The method of claim 1, further comprising causing a shaft of the motor to rotate in a range between 5 and 10 degrees to complete the establishment of the reverse connection between the motor and the impeller.

10. The method of claim 9, wherein:

the motor is an internal combustion engine having a crankshaft; and causing the shaft of the motor to rotate comprises providing an impulse command to a starter motor operatively connected to the crankshaft.

11. A watercraft propulsion system, comprising:

a motor;

a motor status sensor adapted for indicating whether the motor is running or stopped;

an impeller operatively connected to the motor;

an impeller housing receiving the impeller therein;

a gearbox comprising a direct linkage and a reversing gear set;

an actuator operatively connected to the gearbox and adapted for causing the gearbox to selectively establish an operative connection of the impeller to the motor via one of the direct linkage and the reversing gear set;

a gearbox position sensor adapted for indicating whether the impeller is connected to the motor via the direct linkage or the via reversing gear set;

an electronic control unit (ECU), comprising:

a processor communicating with the motor status sensor, with the actuator and with the gearbox position sensor; and a non-transitory computer-readable medium having stored thereon machine executable instructions for performing, when executed by the processor, the method according to claim 1.

12. The watercraft propulsion system of claim 11, wherein the motor status sensor is a motor rotational speed sensor.

13. The watercraft propulsion system of claim 11, wherein:

the motor is an internal combustion engine;

the watercraft propulsion system further comprises an exhaust gas temperature sensor communicating with the processor; and the processor is configured to prevent establishing the reverse connection between the internal combustion engine and the impeller if an exhaust gas temperature meets or exceeds a temperature threshold.

14. The watercraft propulsion system of claim 13, wherein the processor is configured to stop the internal combustion engine if the exhaust gas temperature increases to meet or exceed the temperature threshold when the reverse connection is established between the engine and the impeller.

15. The watercraft propulsion system of claim 11, further comprising:

a timer communicating with the processor;

wherein the processor is configured to evaluate a time duration of operation of the motor with the reverse connection established between the motor and the impeller and to stop the motor if the time duration reaches a duration threshold.

16. The watercraft propulsion system of claim 11, wherein the gearbox comprises:

an input shaft having one end driven by the motor and an opposite end having a first set of dogs; and an output shaft having one end operatively connected to the impeller and an opposite end having a second set of dogs;

wherein the direct linkage is established when the first set of dogs comes in contact with the second set of dogs.

17. The watercraft propulsion system of claim 16, wherein the reversing gear set comprises:

a shifting rod operatively connected to the actuator, the actuator causing the shifting rod to move to a reversing position in response to receiving a reversing command and to move to a normal position in response to receiving a forwarding command;

a shifting fork connecting the shifting rod to the output shaft so that the second set of dogs of the output shaft engages the first set of dogs of the input shaft when the shifting rod is in the normal position, the shifting fork causing a displacement of the output shaft away from the input shaft to disengage the first and second sets of dogs when the shifting rod is in the reversing position; and a shifting shaft adapted for being displaced in parallel to the shifting rod, the shifting shaft carrying gears that engage gears mounted on the input and output shafts to cause a rotation of the output shaft in a direction opposite from a rotation of the input shaft when the shifting rod is in the reversing position, the gear carried by the shifting shaft being disengaged from the gears mounted on the input and output shafts when the shifting rod is in the normal position.

18. The watercraft propulsion system of claim 11, further comprising an impeller shaft operatively connecting the gearbox to the impeller.

19. A watercraft comprising:

a hull having a bow and a stern opposite the bow;

a duct having a water inlet on a lower side of the hull and a water outlet; and the watercraft propulsion system of claim 11, the impeller housing forming a portion of the duct, the impeller being adapted to force water to flow into the duct from the water inlet and to be expelled from the water outlet to propel the watercraft when the watercraft propulsion system operates in the forward direction, the impeller being adapted to force water to flow into the duct from the water outlet and to be expelled from the water inlet when the watercraft propulsion system operates in the reverse direction.

20. The watercraft of claim 19, further comprising:

a vehicle speed sensor for sensing a speed of the watercraft, the vehicle speed sensor communicating with the processor;

wherein the processor is configured to prevent establishing the reverse connection between the motor and the impeller if the speed of the watercraft meets or exceeds a maximum speed threshold.

21. The watercraft of claim 20, wherein the processor is further configured to stop the motor when the reverse connection between the motor and the impeller is established and the speed of the watercraft meets or exceeds the maximum speed threshold.

* * * * *